US012642312B2

(12) United States Patent
Yost et al.

(10) Patent No.: US 12,642,312 B2
(45) Date of Patent: Jun. 2, 2026

(54) MODIFIABLE SWIM SHORT AND METHOD OF USE

(71) Applicants: Gentry Yost, Pocatello, ID (US); Jorge De Amorim Filho, Pocatello, ID (US)

(72) Inventors: Gentry Yost, Pocatello, ID (US); Jorge De Amorim Filho, Pocatello, ID (US)

( * ) Notice: Subject to any disclaimer, the term of this patent is extended or adjusted under 35 U.S.C. 154(b) by 20 days.

(21) Appl. No.: 18/953,264

(22) Filed: Nov. 20, 2024

(65) Prior Publication Data

US 2025/0160449 A1 May 22, 2025

Related U.S. Application Data

(60) Provisional application No. 63/601,310, filed on Nov. 21, 2023.

(51) Int. Cl.
*A41D 7/00* (2006.01)
*A41D 15/00* (2006.01)

(52) U.S. Cl.
CPC ..... *A41D 7/005* (2013.01); *A41D 7/001* (2013.01); *A41D 15/002* (2013.01)

(58) Field of Classification Search
CPC ..... A41D 7/001; A41D 7/005; A41D 15/002; A63B 31/00; B63C 2011/046
See application file for complete search history.

(56) References Cited

U.S. PATENT DOCUMENTS 1,985,568 A * 12/1934 Hall ..... A41D 7/001 D2/731
5,153,944 A * 10/1992 Teel ..... A41D 15/002 2/243.1
5,778,451 A * 7/1998 Rhea ..... A41D 7/001 441/106
6,055,673 A * 5/2000 McCormick ..... A41D 1/06 2/232
7,926,122 B1 * 4/2011 Countryman ..... A41D 1/06 2/234
2008/0109926 A1 * 5/2008 Lieberman ..... B63C 11/04 2/2.16
2009/0007309 A1 * 1/2009 Yamashita ..... D04B 1/16 2/243.1
2018/0008858 A1 * 1/2018 Brooks ..... A63B 21/4043
2018/0111668 A1 * 4/2018 Tortorice ..... B63C 11/04
(Continued)

FOREIGN PATENT DOCUMENTS

CN 201213456 Y * 4/2009

OTHER PUBLICATIONS

Translation of CN 201213456, Li, Qing-Wei, Clothes for Learning Swimming, Apr. 1, 2009 (Year: 2009).*

*Primary Examiner* — Heather Mangine

(57) ABSTRACT

A modifiable swim short for use in a pool or an open water source includes a chassis that has a front waist section, a back waist section, and a crotch section. Descending below the front, back, and crotch sections may be a first leg portion and a second leg portion. The first leg portion may include a plurality of first segments that begin proximate a first leg opening and proceed upward toward the crotch section. The second leg portion may include a plurality of second segments that begin proximate a second leg opening and proceed upward toward crotch section. As a user removes segments from the first and second leg portions, the user becomes less dependent on the shorts and learns proper swimming technique.

10 Claims, 4 Drawing Sheets

(56) References Cited

U.S. PATENT DOCUMENTS

| | | | | |
|---|---|---|---|---|
| 2018/0255853 | A1* | 9/2018 | Spathas | A41D 15/002 |
| 2019/0053547 | A1* | 2/2019 | Butler | A41D 1/22 |
| 2019/0282858 | A1* | 9/2019 | Harkins | B63C 9/115 |
| 2022/0022558 | A1* | 1/2022 | Stockton | A41D 7/00 |
| 2023/0104955 | A1* | 4/2023 | Tomita | A41D 7/00 2/67 |
| 2025/0017297 | A1* | 1/2025 | Gingras | A41D 15/002 |
| 2025/0017298 | A1* | 1/2025 | Marshall | A41H 43/00 |
| 2025/0160449 | A1* | 5/2025 | Yost | A41D 15/002 |

* cited by examiner

MODIFIABLE SWIM SHORT AND METHOD OF USE

CROSS-REFERENCE TO RELATED APPLICATIONS

This application claims the benefit of U.S. Provisional Application Ser. No. 63/601,310, filed on Nov. 21, 2023, which is incorporated herein by reference.

TECHNICAL FIELD

The present disclosure relates to a swimming short. More particularly, the present disclosure relates to a swimming short that is adjustable in length so as to train a swimmer.

BACKGROUND

Swimming is an important skill, especially for those individuals that compete in triathlons or swimming competitions. Many individuals, at a young or old age, take swimming lessons to learn this important skill. However, there are individuals that do not have an opportunity to learn swimming skills, or there may be youth that cannot take swimming lessons. Because there are so many individuals that do not know how to swim or how to swim well, there are devices on the market that assist the individuals, no matter the age or gender. Some of these devices may include life jackets, float collars, floatation belts, and neoprene swimwear, whether suits, tops, or shorts. While these devices may aid in flotation and help an individual swim, they often fail to teach proper swimming technique so as to remove dependency on these devices. Swimming is difficult for many adults who did not learn these skills as a youth and many of these adults rely on these swimming devices to remove the frustration of not knowing how to swim well.

One type of floatation aid is buoyancy swim shorts, which aid in keeping the lower part of the body higher in the water, making it easier to swim faster. Many individuals are dependent on these types of shorts to be able to swim with proper swimming technique, and they may never truly learn how to swim without them.

Accordingly, there is a need for a swimming short and program that assists a user in learning proper swimming technique. The present invention seeks to solve these and other problems.

SUMMARY OF EXAMPLE EMBODIMENTS

In one embodiment, a modifiable swim short for use in a pool or another water source comprises a chassis that includes a front waist section, a back waist section, and a crotch section that is disposed longitudinally between the front and back waist sections. A waist band may circumscribe an opening to enter the shorts.

Descending below the front, back, and crotch sections may be a first leg portion and a second leg portion. The first leg portion may comprise a plurality of first segments that begin proximate a first leg opening and proceed upward toward the front and back waist sections and the crotch section. The plurality of first segments may include a first segment, a second segment, a third segment, a fourth segment, a fifth segment, and a sixth segment. The second leg portion may comprise a plurality of second segments that begin proximate a second leg opening and proceed upward toward the front and back waist sections and the crotch section. The plurality of second segments may include a seventh segment, an eighth segment, a ninth segment, a tenth segment, an eleventh segment, and a twelfth segment.

In one embodiment, a method of using the modifiable swim short with its respective program comprises a user swimming with the shorts for a first period of time and/or until a first objective is met. The user removes a first segment of first segments on a first leg portion and a seventh segment from second segments on a second leg portion. The user swims with the shorts for a second period of time and/or until a second objective is met. The user removes a second segment of the first segments on the first leg portion and an eighth segment from the second segments on the second leg portion. The user swims with the shorts for a third period of time and/or until a third objective is met. The user removes a third segment of the first segments on the first leg portion and a ninth segment from the second segments on the second leg portion. The user swims with the shorts for a fourth period of time and/or until a fourth objective is met. The user removes a fourth segment of the first segments on the first leg portion and a tenth segment from the second segments on the second leg portion. The user swims with the shorts for a fifth period of time and/or until a fifth objective is met. The user removes a fifth segment of the first segments on the first leg portion and an eleventh segment from the second segments on the second leg portion. The user swims with the shorts for a sixth period of time and/or until a sixth objective is met. The user removes a sixth segment of the first segments on the first leg portion and a twelfth segment from the second segments on the second leg portion. Once all segments have been removed, the user has finished the program.

In one embodiment, a method of using the modifiable swim short with its respective program comprises a user swimming with the shorts until one or more predetermined objectives are met. Then the user removes one or more first segments and one or more second segments from each leg of the modifiable swim shorts. The user swims until his or her personalized swimming goals are reached.

DETAILED DESCRIPTION OF EXAMPLE EMBODIMENTS

Figure 1:
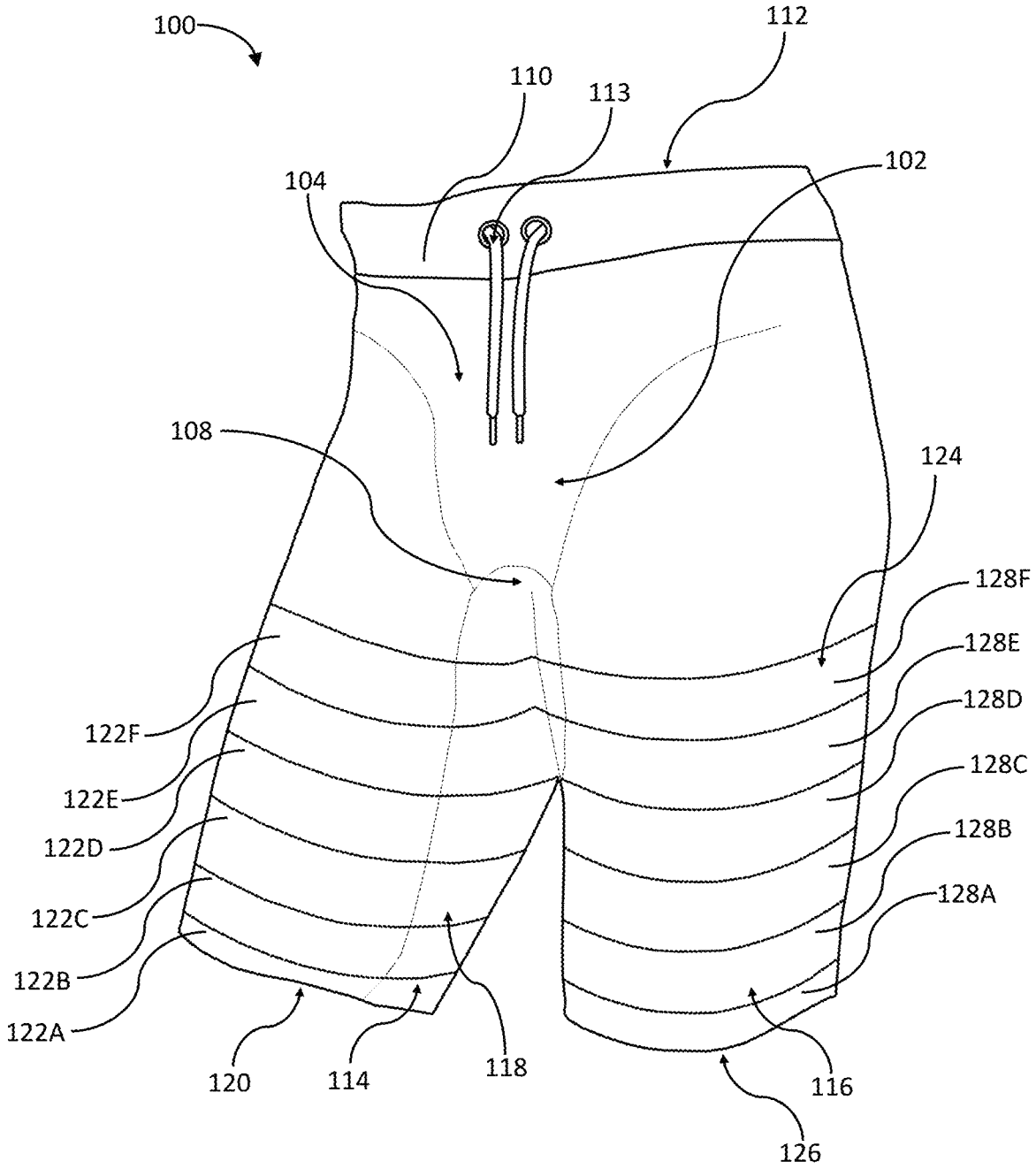
FIG. 1 illustrates a front, side perspective view of a modifiable swim short.

While embodiments of the present disclosure may be subject to various modifications and alternative forms, specific embodiments have been shown by way of example in the drawings and will be described in detail herein. However, the present disclosure is not intended to be limited to the particular features, forms, components, etc. disclosed. Rather, the present disclosure will cover all modifications, equivalents, and alternatives falling within the scope of the present disclosure.

Reference to the invention, the present disclosure, or the like are not intended to restrict or limit the invention, the present disclosure, or the like to exact features or steps of any one or more of the exemplary embodiments disclosed herein. References to "one embodiment," "an embodiment,"

"alternate embodiments," "some embodiments," and the like, may indicate that the embodiment(s) so described may include a particular feature, structure, or characteristic, but not every embodiment necessarily includes the particular feature, structure, or characteristic.

Any arrangements herein are meant to be illustrative and do not limit the invention's scope. Although specific terms are employed herein, they are used in a generic and descriptive sense only and not for purposes of limitation. Unless otherwise defined herein, such terms are intended to be given their ordinary meaning not inconsistent with that applicable in the relevant industry and without restriction to any specific embodiment hereinafter described.

It will be understood that the steps of any such processes or methods are not limited to being carried out in any particular sequence, arrangement, or with any particular graphics or interface. In fact, the steps of the disclosed processes or methods generally may be carried out in various, different sequences and arrangements while still being in the scope of the present invention. Certain terms are used herein, such as "comprising" and "including," and similar terms are meant to be "open" and not "closed" terms. These terms should be understood as, for example, "including, but not limited to."

As previously described, there is a need for a swimming short and program that assists a user in learning proper swimming technique. The present invention seeks to solve these and other problems.

Swimming may be difficult for individuals who did not grow up swimming and did not have swimming lessons, never learning proper technique. It can be frustrating and time consuming to learn to swim with proper technique. Buoyancy swim shorts can act as a swim aid for many. Specifically, buoyancy swim shorts assist the individual by keeping the lower part of the body higher in the water, which makes it easier to swim and swim faster. While there are many buoyancy swim shorts on the market, these shorts have one major shortcoming. That is, individuals become dependent on these shorts and fail to learn proper swimming technique. While some may not show any concern about learning swimming technique, others would pursue the opportunity to learn proper technique, which would make them a faster, better, and more consistent swimmer.

The modifiable swim short described herein includes a chassis, a front waist section, a back waist section, and a crotch section. The shorts include multiple segments on a first leg portion and a second leg portion. The segments allow a user to decrease the length of each leg portion to remove dependency on the shorts and improve swimming technique.

It will be appreciated that the shorts and method of use described herein allow users to enjoy the benefit and ease of swimming with buoyancy shorts, but aides them in how to reduce their dependence on them as their swimming improves. It will further be appreciated that the shorts may be configured to be incrementally cut/shortened as swim technique improves in a step-wise manner. As such, learning to swim becomes more enjoyable and difficult swim workouts are more likely to be completed and not dreaded and skipped. This leads to better performances for competitive athletes and will keep people engaged in all swimming ventures. Furthermore, it will be appreciated that these shorts may be used by any individual regardless of age or gender.

Figure 2:
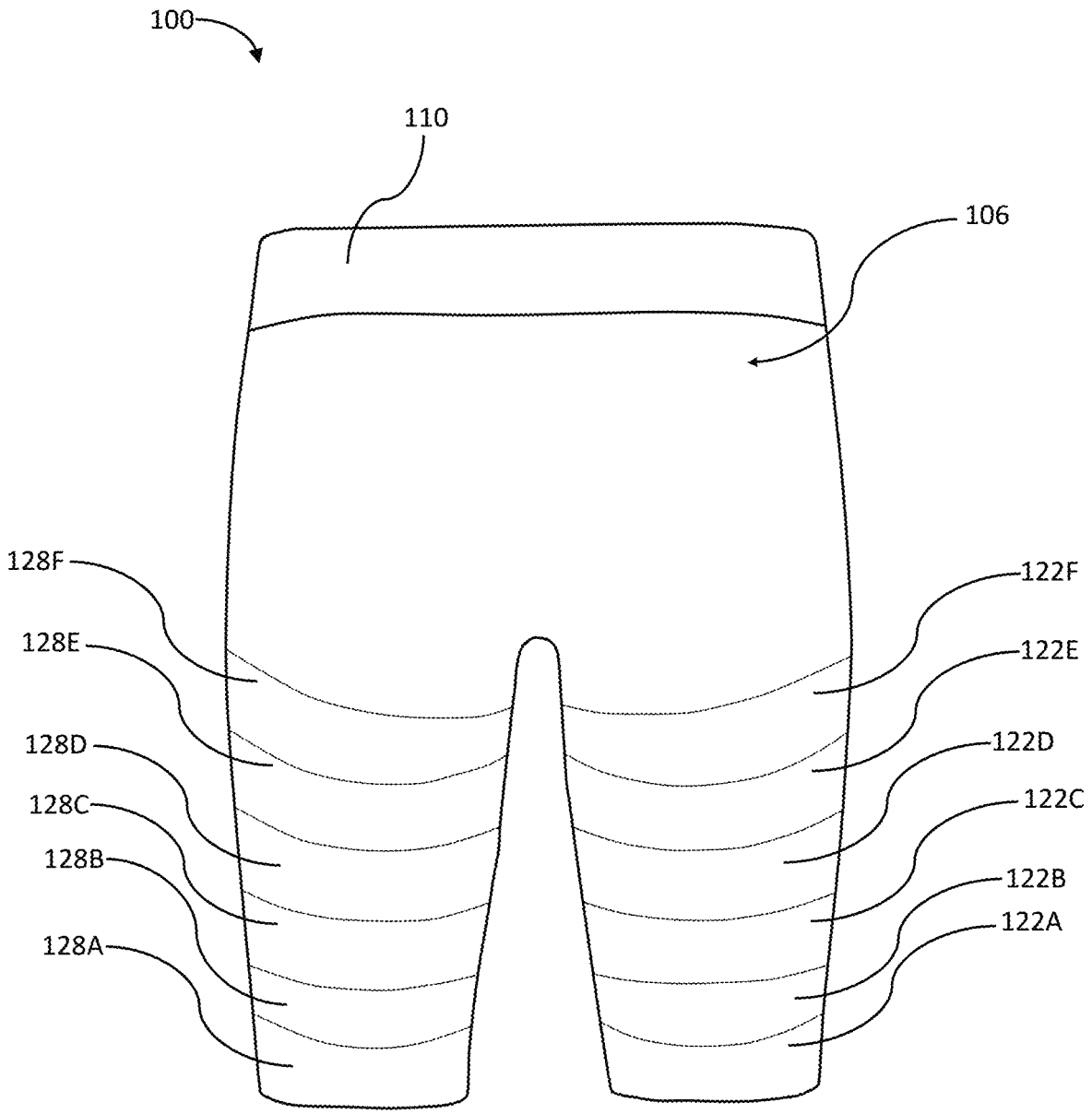
FIG. 2 illustrates a rear elevation view of a modifiable swim short.

As shown in FIGS. 1-2, in one embodiment, a modifiable swim short 100 (hereinafter referred to as the "shorts") for use in a pool or an open water source comprises a chassis 102 that includes a front waist section 104, a back waist section 106, and a crotch section 108 that is disposed between the front and back waist sections 104, 106. The front waist section 104 and the back waist section 106 generally include those portions of the short 100 which, when worn, encircle the waist of the wearer/user. The crotch section 108 is that portion of the short 100 which, when the short 100 is worn, is generally positioned between the legs of the wearer. A waist band 110 may circumscribe an opening 112 to enter the shorts 100. The waist band 110 may be manufactured out of the same material or a different material than the front and back waist sections 104, 106 and the crotch section 108. For example, the waist band 110 may be manufactured out of an extensible material while the front and back waist sections 104, 106 and the crotch section 108 are manufactured out of a semi-extensible material. In some embodiments, the waist band 110 may include grips or any other securement material so as to hold the shorts 100 in place. Furthermore, in some embodiments, the front and back waist sections 104, 106 and the crotch section 108 may be different materials or the same materials. The waist band 110 may comprise a draw string 113. In some embodiments, the waist band 110 may include snaps, buckles, or any other type of fastening mechanism used for shorts or pants known in the art.

Descending below the front, back, and crotch sections 104-108 may be a first leg portion 114 and a second leg portion 116. The first leg portion 114 when on the leg of a user may extend a first length that terminates proximate the knee of the user. Similarly, the second leg portion 116 when on the leg of a user may extend a second length that terminates proximate the user's second knee. The first and second leg portions 114, 116 may be tubular in shape and tapered toward the knees of the user. In other embodiments, the length of the first and second leg portions 114, 116 may be longer or shorter than generally knee length. For example, in some embodiments, the first and second leg portions 114, 116 may extend to the calf muscle, to the ankles, or halfway between the hip and knee. Accordingly, it will be understood the first and second leg portions 114, 116 may be a variety of different lengths and may be modifiable/customizable by a user.

The first leg portion 114 may comprise a plurality of first segments 118 that begin proximate a first leg opening 120 and proceed upward toward the front and back waist sections 104, 106 and the crotch section 108. As the plurality of first segments 118 move upward toward the front and back waist sections 104, 106 and the crotch section 108, the plurality of first segments 118 may begin to curve until termination so as to create the shape and function of a swim brief when all segments are removed. The plurality of first segments 118 may be generally horizontal segments that move upward towards the crotch section 108. The plurality of first segments 118 may include a first segment 122A, a second segment 122B, a third segment 122C, a fourth segment 122D, a fifth segment 122E, and a sixth segment 122F. The second leg portion 116 may comprise a plurality of second segments 124 that begin proximate a second leg opening 126 and proceed upward toward the front and back waist sections 104, 106 and the crotch section 108. As the plurality of second segments 124 move toward the front and back waist sections 104, 106 and the crotch section 108, the plurality of second segments 124 begin to curve until termination so as to create the shape and function of a swim brief when all segments, on both legs, are removed. The plurality of second segments 124 may be generally horizontal segments that move upward towards the crotch section 108. The plurality of second segments 124 may include a seventh segment 128A, an eighth segment 128B, a ninth segment 128C, a tenth segment 128D, an eleventh segment 128E, and a twelfth segment 128F.

Each segment 122A-122F of the plurality of first segments 118 may be removed as well as each segment 128A-128F of the plurality of second segments 124. For example, the plurality of first segments 118 may be removed one by one starting near the first leg opening 120 and continuing until the last segment is removed near the crotch section 108. Each segment of the first and second segments 118, 124 may be defined by lines that are colored, whether solid or dashed, or any other indicia, so as to provide direction for a user to remove each segment with a cutting device. For example, the segments may be alternating colors, such as green and black. In some embodiments, each segment of the first and second segments 118, 124 may be removably attachable, meaning capable of reattachment, and be fastened to each other via zippers, hook and loop, snap buttons, magnets, or any other securement mechanism. In some embodiments, the segments 118, 124 may utilize perforations so as to allow a user to tear each segment off. In some embodiments, the first and second segments 118, 124 may each comprise eight segments. However, it will be understood that the first and second segments 118, 124 may include more or less than twelve segments. For example, each segment 118, 124 may include four segments. In some embodiments, the first and second segments 118, 124 may each be a height of one inch; however, other heights may be utilized which are taller or shorter than one inch. It will also be appreciated that while the segments may all be the same height in some embodiments, other embodiments may comprise segments with staggered heights. As an example, segments nearest the first and second leg openings 120, 126 may be one inch while the adjacent segment is two inches in height. One or more segments may be removed by a user, meaning that if the user is learning quickly, that the user may remove, for example, two segments at a time.

While the shorts 100 described herein include defined segments, it will be understood that the method described below may be performed with other swim shorts lacking segments. Furthermore, the method of use described below, if used with swim shorts lacking segments, may instruct a user to utilize a ruler or other measuring device to measure the shorts and mark them so as to remove the necessary amount to comply with the method of use (i.e., training program).

The shorts 100 may be manufactured from a neoprene material. Other materials used for the shorts 100 may include any other type of material that has buoyancy properties. Further, the shorts 100 may include different thicknesses of material to aid the user in developing swimming skills, meaning there may be different thicknesses of the shorts 100 that a user may choose from based on that user's swimming skills. For example, a version of the shorts 100 with a thicker, more buoyant material may be used by a less skilled swimmer, while a version of the shorts 100 with a thinner, less buoyant material may be used by a more skilled swimmer. In some embodiments, the shorts 100 and/or the first and second segments may be color coded to notify the user of the thickness of the shorts, the first and second segments that need to be removed, sizes of the shorts, and/or gender or age specific shorts. Other indicia may be utilized that include numbering, proprietary markings, etc.

Figure 3:
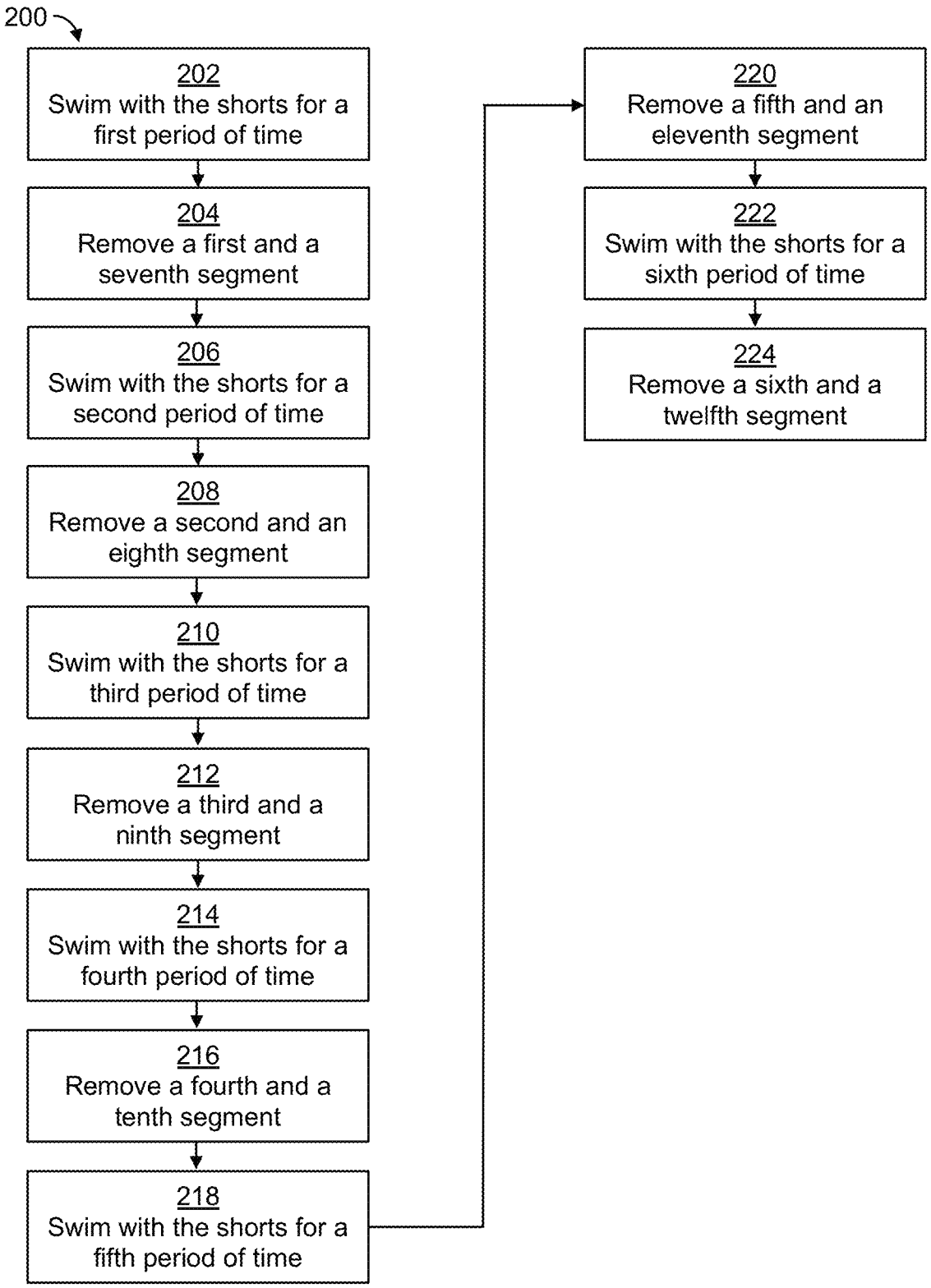
FIG. 3 illustrates a diagram of a method of use for a modifiable swim short.

As shown in FIG. 3, in one embodiment, a method of using the modifiable swim short with its respective program 200 comprises a user swimming with the shorts 100 for a first period of time (e.g., one week) and/or until a first objective (e.g., a certain skill or swimming technique is learned) is met, at step 202. Then, at step 204, the user removes a first segment of first segments on a first leg portion and a seventh segment from second segments on a second leg portion. At step 206, the user swims with the shorts 100 for a second period of time (e.g., one week) and/or until a second objective is met. At step 208, the user removes a second segment of the first segments on the first leg portion and am eighth segment from the second segments on the second leg portion. At step 210, the user swims with the shorts 100 for a third period of time (e.g., one week) and/or until a third objective is met. At step 212, the user removes a third segment of the first segments on the first leg portion and a ninth segment from the second segments on the second leg portion. At step 214, the user swims with the shorts 100 for a fourth period of time (e.g., one week) and/or until a fourth objective is met. At step 216, the user removes a fourth segment of the first segments on the first leg portion and a tenth segment from the second segments on the second leg portion. At step 218, the user swims with the shorts 100 for a fifth period of time (e.g., one week) and/or until a fifth objective is met. At step 220, the user removes a fifth segment of the first segments on the first leg portion and an eleventh segment from the second segments on the second leg portion. At step 222, the user swims with the shorts 100 for a sixth period of time (e.g., one week) and/or until a sixth objective is met. At step 224, the user removes a sixth segment of the first segments on the first leg portion and a twelfth segment from the second segments on the second leg portion. Once all segments have been removed, the user has finished the program.

Figure 4:
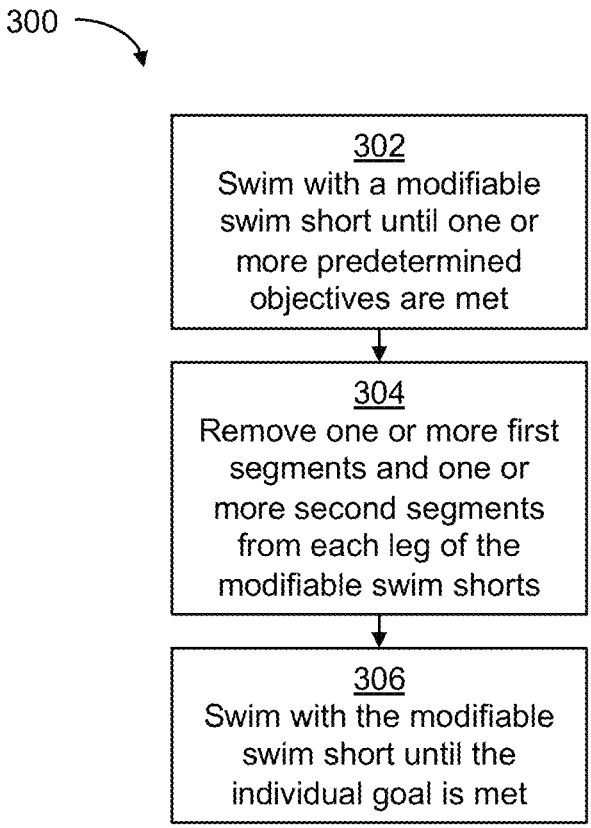
FIG. 4 illustrates a diagram of a method of use for a modifiable swim short.

As shown in FIG. 4, in one embodiment, a method of using the modifiable swim short with its respective program 300 comprises a user swimming with the shorts 100 until one or more predetermined objectives are met, at step 302. The one or more predetermined objectives may include, for example, swimming for a specific number of times or laps and/or until a certain skill or swimming technique is learned. Then, at step 304, the user removes one or more first segments and one or more second segments from each leg of the modifiable swim shorts 100. At step 306, the user swims until his or her personalized swimming goals are reached, meaning, for example, that freestyle swimming techniques are learned and can be utilized without the aid of a buoyancy short.

As discussed herein, in other embodiments, the number of segments may vary from shorts to shorts. Accordingly, there may be more or less steps than discussed above. With each cut or removal of each segment, the shorts 100 provide less and less buoyancy for the user, thereby helping the user reduce their dependency on the shorts 100 as their swimming improves. The periods of time discussed within the steps may include and provide users with prescribed swim work outs and graded/timed sessions that will guide them as to when they are ready to remove segments from the shorts 100. After segments of the first and second segments 118, 124 have been removed, the user will repeat the prescribed swim workouts (i.e., objectives) and then reassess to determine if further shortening is warranted. When a user has removed the last segments, the user has finished/graduated from the program.

It will be understood that while various embodiments have been disclosed herein, other embodiments are contemplated. Further, certain embodiments of the present disclosure may include, incorporate, or otherwise comprise properties or features described in other embodiments.

Consequently, various features of certain embodiments can be compatible with, combined with, included in, and/or incorporated into other embodiments of the present disclosure. Therefore, disclosure of certain features or components relative to a specific embodiment of the present disclosure should not be construed as limiting the application or inclusion of said features or components to the specific embodiment unless stated. As such, other embodiments can also include said features, components, members, elements, parts, and/or portions without necessarily departing from the scope of the present disclosure. The embodiments described herein are examples of the present disclosure. Accordingly, unless a feature or component is described as requiring another feature or component in combination therewith, any feature herein may be combined with any other feature of a same or different embodiment disclosed herein. Although only a few of the example embodiments have been described in detail herein, those skilled in the art will appreciate that modifications are possible without materially departing from the present disclosure described herein. Accordingly, all modifications may be included within the scope of this invention.

What is claimed is:

1. A method of using a modifiable buoyant swim short comprising:

swimming with the modifiable swim short for one or more predetermined objectives, the modifiable swim short comprising:

a buoyant material, a chassis, the chassis comprising:

a front waist section, a back waist section, a crotch section that is disposed between the front and back waist sections, and a first leg portion descending below a first side of the front, back, and crotch sections, the first leg portion comprising one or more first segments, wherein the first leg portion is adapted to terminate proximate a first knee, and the first leg portion tapers from the front, back, and crotch sections as the first leg portion moves distally from the front, back, and crotch sections towards the first knee when the modifiable swim short is worn;

a second leg portion descending below the front, back, and crotch sections on a second side, the second leg portion comprising one or more second segments, wherein the second leg portion is adapted to terminate proximate a second knee, and the second leg portion tapers from the front, back, and crotch sections as the second leg portion moves distally from the front, back, and crotch sections towards the second knee when the modifiable swim short is worn;

removing the one or more first segments and the one or more second segments after each of the one or more predetermined objectives are completed.

2. The method of using the modifiable swim short of claim 1, wherein the one or more first segments move upward along the first leg portion until terminating at the front waist section, the back waist section, and the crotch section, and the one or more second segments move upward along the second leg portion until terminating at the front waist section, the back waist section, and the crotch section.

3. The method of using the modifiable swim short of claim 1, wherein the one or more first segments are removably attachable to each other, and the one or more second segments are removably attachable to each other.

4. The method of using the modifiable swim short of claim 1, wherein the one or more first segments are defined by first indicia, and the one or more second segments are defined by second indicia.

5. The method of using the modifiable swim short of claim 1, wherein the one or more first segments comprise a first segment, a second segment, a third segment, a fourth segment, a fifth segment, and a sixth segment, and the one or more second segments comprise a seventh segment, an eighth segment, a ninth segment, a tenth segment, an eleventh segment, and a twelfth segment.

6. The method of using the modifiable swim short of claim 4, wherein the first and second indicia are lines.

7. The method of using the modifiable swim short of claim 5, wherein removing the one or more first segments and the one or more second segments comprises cutting off the first and seventh segments after a first objective of the one or more predetermined objectives is completed, cutting off the second and eighth segments after a second objective of the one or more predetermined objectives is completed, cutting off the third and ninth segments after a third objective of the one or more predetermined objectives is completed, cutting off the fourth and tenth segments after a fourth objective of the one or more predetermined objectives is completed, cutting off the fifth and eleventh segments after a fifth objective of the one or more predetermined objectives is completed, and cutting off the sixth and twelfth segments after a sixth objective of the one or more predetermined objectives is completed.

8. The method of using the modifiable swim short of claim 1, wherein the one or more predetermined objectives comprises one or more periods of time.

9. The method of using the modifiable swim short of claim 8, wherein one of the one or more periods of time comprises a week.

10. The method of using the modifiable swim short of claim 1, wherein the buoyant material comprises neoprene.

* * * * *